United States Patent [19]

Eisenberg

[11] 4,418,436

[45] Dec. 6, 1983

[54] BRUSH BRISTLE CLEANING SYSTEM

[76] Inventor: Abraham Eisenberg, 6604 Chippewa Dr., Baltimore, Md. 21209

[21] Appl. No.: 351,011

[22] Filed: Feb. 22, 1982

[51] Int. Cl.[3] ..... A46B 17/06

[52] U.S. Cl. ..... 15/104 R; 15/142

[58] Field of Search ..... 15/104 R, 141 R, 142; 366/129, 342, 343

[56] References Cited

U.S. PATENT DOCUMENTS

| | | | |
|---|---|---|---|
| 2,694,880 | 11/1954 | Artese et al. | 15/104 R |
| 2,906,510 | 9/1959 | Harris | 15/141 R X |
| 2,922,628 | 1/1960 | Koe | 366/129 |

*Primary Examiner*—Chris K. Moore

*Attorney, Agent, or Firm*—Morton J. Rosenberg

[57] ABSTRACT

A brush bristle cleaning system (10) which is adapted to be manually operable and held in one hand of the user. The brush bristle cleaning system (10) includes a frame within which is inserted a helical wire element (34) defining a plurality of helical loops (36) which extend in longitudinal direction (26) between and attached to leg members (20 and 22) of frame member (18). The helical loops (36) are provided with differing diameters in a monotonically increasing dimension from the end portions to the central section of the longitudinally extended helical wire element (34). The frame (18) is combination with the differing diameter helical loops (36) provide end spaces (44 and 46) which allow helical loops (36) to be vertically displaced, as well as longitudinally displaced. Brush bristles (12) of brush (14) are inserted between helical loops (36) and moved in both vertical direction (28) as well as longitudinal direction (26) to remove particles of paint adhering to bristles (12).

9 Claims, 3 Drawing Figures

FIG. 1
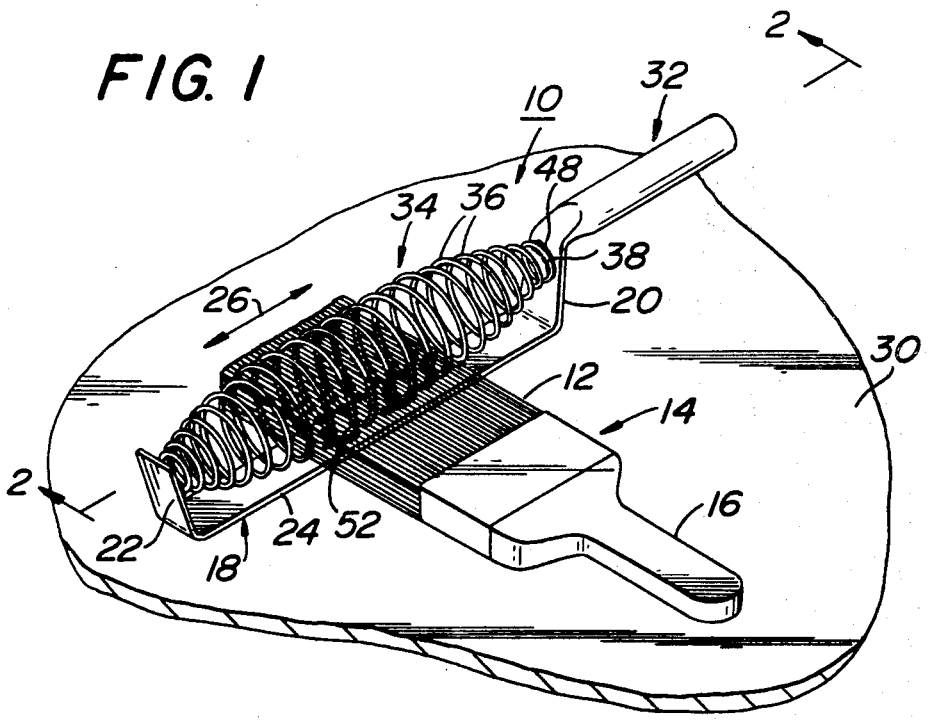
FIG. 2
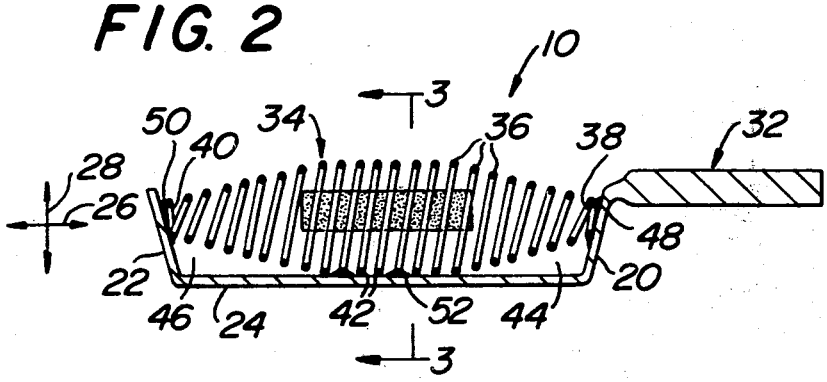
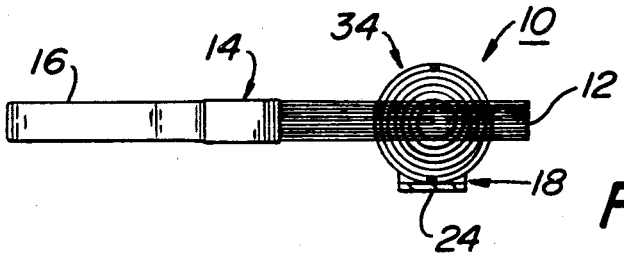
FIG. 3

BRUSH BRISTLE CLEANING SYSTEM

BACKGROUND OF THE INVENTION

1. Field of the Invention

This invention pertains to manually operable brush bristle cleaning systems for optimizing the operational use of a paintbrush either prior to or subsequent to painting operations. In particular, this invention relates to a cleaning system which removes paint or other material contained on brush bristles and further, to decouple the brush bristles each from the other to provide a homogeneous layer of paint to be applied to a predetermined surface. Still further, this invention relates to a brush bristle cleaning system which provides for a frame onto which helical wire elements are secured. Further, this invention relates to a brush bristle cleaning system where the helically wound wire elements provide a plurality of helical loops having the same or differing dimension in order to provide additional flexibility when brush bristles are applied between the helical loops. Further, this invention pertains to a brush bristle cleaning system which is easily held in one hand of a user while the brush is manually applied with the other hand of the user. Still further, this invention pertains to a brush bristle cleaning system which is of low cost to manufacture and is easily manipulatable by a user during a cleansing operation.

2. Prior Art

Paint brush cleaning systems are well-known in the art. Prior art systems known to the inventor include U.S. Pat. Nos. 2,726,696; 3,430,286; 3,470,575; 2,737,945; 3,085,282; 3,147,501; and, 4,018,240. These prior art references were known to the inventor as prior art systems when U.S. Ser. No. 170,090, filed July 18, 1980 was applied for at the U.S. Patent and Trademark Office, by the same Applicant, now U.S. Pat. No. 4,308,634.

During prosecution of the above-referenced patent application, the U.S. Patent and Trademark Office cited U.S. Pat. Nos. 678,586; 698,065; 1,134,170; 1,553,023; 00414 and, 2,945,251. Additionally, foreign references cited in the above-referenced patent application included French Pat. No. 371,937 having a date of March, 1907, and a Swiss Pat. No. 450,237 having a date of April, 1968. In all of the prior art Patents cited by the U.S. Patent and Trademark Office, it did not appear that any of the cited references provided for a helical coil wire element extending in a longitudinal direction for the purposes and objectives as provided in this Application. Although U.S. Pat. No. 2,945,251 did provide for helical coil members, such was directed to a paint holding device which apparently held the paintbrush handle between adjacent helical wires.

In other prior art paintbrush cleaning systems, such as that provided in U.S. Pat. No. 3,430,286, such were directed to systems having rollers within which a paintbrush may be inserted. In such prior art systems, the rollers were apparently moved toward each other and the paintbrush was squeezed therebetween in a wringing action. However, such types of prior art paintbrush cleaning systems did not separate the bristles of the paintbrush, since the rollers were continuous in nature.

In other prior art types of cleaning systems, such as that shown in U.S. Pat. No. 3,470,575, such were directed to cleaning bristles for hair brushes. Such prior art systems were rotationally actuated, and in some cases, could be motor driven. In these types of systems, fingers rotated and apparently cooperated with each other between the brush bristles to pick up debris which was contained on the brush or the bristles. Such prior systems did provide for finger type elements, but such were not adaptable to the helical wound elements as is provided in the subject invention concept.

Still other types of cleaning systems such as that shown in U.S. Pat. No. 2,737,945 did include upper apex edges around which the bristles were passed. The apices do in some manner allow the displacement of the bristles with respect to each other. However, such did not provide for the flexing of the helically wound elements which allows for removal of the material contained within the bristles, as is provided in the subject invention concept.

SUMMARY OF THE INVENTION

A brush bristle cleaning system which includes a frame including a longitudinally extending base member. A handle member is provided which is secured to one end of the overall cleaning system. A helical wire element defining a plurality of helical loops extends in the longitudinal direction.

BRIEF DESCRIPTION OF THE DRAWINGS

FIG. 1 is a perspective view of the brush bristle cleaning system of the subject invention concept showing a brush inserted between helical loops mounted within a frame;

FIG. 2 is a side view of the brush bristle cleaning system; and,

FIG. 3 is a sectional view of the brush bristle cleaning system taken along the section lines 3—3 of FIG. 2.

DESCRIPTION OF THE PREFERRED EMBODIMENTS

Referring now to FIGS. 1–3, there is shown brush bristle cleaning system 10 for cleaning bristles 12 of paint brush 14 subsequent to a painting operation or some like use. Paint brush 14 is a standard paint brush adapted for manual operation and includes paint brush handle 16 which is grasped by the user during the painting operation. In overall concept, brush bristle cleaning system 10 is manually operated in combination with paint brush 14 to maintain bristles 12 in non-coupled relation each with respect to the other, and to provide resilient bristles 12 for optimum ease of use in a painting operation. As will be described in following paragraphs, utilization of brush bristle cleaning system 10 allows bristles 12 of paint brush 14 to be maintained in a flexible condition and decoupled from adjacent bristles 12 in a state of readiness for a next painting operation. Additionally, bristle cleaning system 10 may be used prior to a painting operation where it is found that the bristles 12 are stiff and possibly attached each to the other. Use of system 10 in this environment allows the user to easily disengage the bristles 12 from a coupled relation each with respect to the other, and provide a homogeneous coating of paint to be applied to a predetermined surface. Brush bristle cleaning system 10 provides the user with an easily manipulatable system which is inexpensive to manufacture and provides for optimum cleaning of paint brush bristles 12.

In prior applications, brush bristles 12 have been cleaned and decoupled each from the other subsequent to a painting operation, generally by insertion into a paint solvent such as turpentine. However, when bristles 12 of paint brush 14 are maintained within a paint solvent of this type for prolonged periods of time, bristles 12 have had the tendency to absorb some of the solvent or have some of the solvent adsorbed onto brush bristles 12. When paint brush bristles 12 are then inserted into a paint, such paint is diluted and there is the possibility of streaking and the probability of a non-homogeneous layer of paint being applied to a surface. In the alternative, when paint brushes 14 are maintained within the aforementioned solvents for an insufficient amount of time, prior to a complete cleaning of bristles 12, such bristles 12 are maintained in a coupled relation each with respect to the other and once again, a streaking effect is found in the paint layer applied to the predetermined surfaces.

Brush bristle cleaning system 10 includes frame 18 clearly shown in FIGS. 1 and 2. Frame 18 may be U-shaped in contour and may include a pair of vertically extending leg members 20 and 22 and base member 24. As can be seen, base member 24 extends in longitudinal direction 26 and leg members 20 and 22 extend substantially in vertical direction 28. Leg members 20 and 22 are secured to base member 24 in a fixed securement mode, such as through welding, bolting, or some like technique. In the embodiment shown in FIGS. 1–3, leg members 20 and 22 are formed in generally one-piece formation with base member 24 to provide a unitary frame 18. Base member 24 as can be seen, is generally rectangular in contour and planar throughout its extended length in longitudinal direction 26.

Base member 24 is planar in contour in order that such may, but does not necessarily have to, matingly interface with base surface 30, as shown in FIG. 1. Base surface 30 may be an external surface upon which base member 24 rests during operation of brush bristle system 10. Alternatively, base surface 30 may be the surface of a pan which contains paint solvent, within which entire brush bristle cleaning system 10 and paint brush 14 is at least partially immersed in order to aid in the overall cleaning of paint brush bristles 12. U-shaped frame 18 is generally formed of a metal composition such as aluminum, copper, or some like metallic composition material, which may be easily cleaned by immersion within a paint solvent.

Cleaning system 10 further includes handle member 32 which is seen in FIGS. 1 and 2 to be secured to substantially vertically directed leg member 20 of frame 18. Handle member 32 extends in longitudinal direction 26 and is seen to be generally parallel to a plane formed by base member 24. Handle member 32 may be secured to leg member 20 by welding, bolting, or some like technique. In the preferred embodiment as shown in FIGS. 1 and 2, handle member 32 is formed in one-piece relation with frame 18.

The particular securement method or technique used to couple handle member 32 to frame 18 is not important to the inventive concept as herein described, with the exception that such coupling be of a secured nature which allows structural integrity throughout the manipulation of paint brush 14 in the operational phase of the cleaning of paint brush bristles 12. Handle member 32 may be formed of a metal composition, much the same or identical to, the metal composition of frame 18. Thus, handle member 32 may be formed of an aluminum, copper, or some like metallic composition. Additionally, it is to be understood that the particular handle contour is not important to the inventive concept as is herein described, with the exception that handle member 32 be of a size and dimension adaptable to be generally held in the hand of a user. Thus, handle member 32 may be formed of a tubular member or in the alternative, may be formed of a wire type handle which is adapted to be easily held in one hand of the user.

Brush bristle cleaning system 10 further includes helical wire element 34 defines a plurality of helical loops 36. As can be seen in FIGS. 1 and 2, helical wire element 34 extends in longitudinal direction 26 and is positionally located between leg members 20 and 22. Additionally, helical wire element 34 is fixedly secured to leg members 20 and 22 at opposing ends of helical wire element 34, although helical wire element 34 may also be fixedly secured at predetermined points along the frame, where the frame does not include leg members.

Helical loops 36 of helical wire element 34 are seen to have differing diameters throughout the longitudinal extension of helical wire element 34 between leg members 20 and 22. End helical loops 38 and 40 are seen to be coupled in secured fashion to leg members 20 and 22 and include diameters which are substantially smaller than central helical loops 42. Thus, as is seen in FIG. 2, the diameter dimensions of helical loops 36 are substantially symmetrical about a center of the longitudinally extended base member 24. The smaller diameter of helical loops 36 on opposing sides of a central section of base member 24 defines area spaces 44 and 46 as shown in FIG. 2, wherein helical loops 36 in these areas do not contact and are not contiguous with base member 24. Helical loops 36 provide for diameters which are substantially monotonically increasing from opposing leg members 20 and 22 to substantially the center of longitudinally extended base member 24.

As can be seen, welding areas 48 and 50 are provided in an area which allows for area spaces 44 and 46 to be maintained above base member 24. Thus, helical loops 36 in areas defined by area spaces 44 and 46 may be reversibly displaced in vertical direction 28 in an easier manner than would be provided with other types of envelope contours of helical wire element 34. It is to be understood that the cleansing of brush bristles 12 is highly dependent upon both reversible movement of helical loops 36 in vertical direction 28, as well as longitudinal direction 26.

Additionally, central helical loops 42 are coupled to base member 24 through welding or some like technique with the welding defined by element 52, as shown in FIG. 2. In this manner, central helical loops 42 may be moved or displaced in reversible direction 26 while during operation, helical loops above end area spaces 44 and 46 may be both moved in reversible longitudinal direction 26, as well as reversible vertical direction 28 to provide ease in cleansing of brush bristles 12.

In operation, when brush bristle cleaning system 10 is used subsequent to a painting operation, it is clearly seen that base member 24 is applied to a base surface 30 or to a surface within a pan containing solvent, or in the alternative may be held free of any surface. Handle member 32 of system 10 is grasped in one hand by the user and the paint brush handle 16 is grasped in the other hand. Brush bristles 12 are inserted between helical coils 36 of helical wire element 34 and moved in both a vertical direction 28, as well as a reversible longitudinal direction 26. Particles of paint are thus dislodged from individual bristles 12 and are either dissolved in the solvent, or otherwise dislodged from the surface of bristles 12. Additionally, bristles 12 are moved to either end of frame 18 and helical coils 36 above area spaces 44 and 46 are displaced in both vertical and longitudinal directions 28 and 26, respectively, to provide additional dislodgement and movement of bristles 12 and paint adhered thereto.

In operations where system 10 is used prior to a painting operation, the user may find that bristles 12 are somewhat stiff and coupled each to the other. The decoupling procedure is substantially the same as the cleansing operation used subsequent to a painting operation. Thus, system 10 may be placed on an external or base surface 30 and brush 14 passed in both a longitudinal direction 26 and a vertical direction 28, as previously described. In this manner, there is provided brush cleaning system 10 which is manually useable and optimizes the cleaning procedure and operation by a user. Additionally, system 10 provides a tool which is easily manufactured and inexpensive to make.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, 01717 particular locations of elements may be reversed or interposed, all without departing from the spirit or scope of the invention as defined in the appended claims.

What is claimed is:

1. A brush bristle cleaning system including:

(a) a frame defining a longitudinally extending base member;

(b) a handle member; and, (c) a helical wire element defining a plurality of helical loops, said helical wire element extending in said longitudinal direction, said helical wire element being secured to said frame and said handle member, said helical wire element being fixedly secured to said frame at discrete locations.

2. The brush bristle cleaning system as recited in claim 1 where said helical loops of said helical wire element having differing diameters through said longitudinal extension of said helical wire element.

3. The brush bristle cleaning system as recited in claim 2 where said diameter dimensions of said helical loops are substantially symmetrical about a center of said longitudinally extended base member.

4. The brush bristle cleaning system as recited in claim 3 where said helical loop diameters are substantially monotonically increasing from said opposing leg members to substantially said center of said longitudinally extended base member.

5. The brush bristle cleaning system as recited in claim 1 where said fixed securement locations include fixed securement of opposing helical loops to a pair of frame leg members and at least one of said helical loops fixedly secured to said base member.

6. The brush bristle cleaning system as recited in claim 5 where said helical loop securement to said frame is through welding securement.

7. The brush bristle cleaning system as recited in claim 1 where said handle extends in said longitudinal direction and in a plane substantially parallel to a plane of said frame base member.

8. The brush bristle cleaning system as recited in claim 7 where said frame and said handle are formed in one-piece formation.

9. The brush bristle cleaning system as recited in claim 7 where said frame and handle are formed of a metal composition.

* * * * *